United States Patent [19]

Pagliaro

[11] Patent Number: 4,696,220

[45] Date of Patent: Sep. 29, 1987

[54] VIOLIN STUDENT SIZING DEVICE

[76] Inventor: Michael J. Pagliaro, 219 Sprain Rd., Scarsdale, N.Y. 10583

[21] Appl. No.: 940,111

[22] Filed: Dec. 10, 1986

[51] Int. Cl.[4] ..... G10G 7/00

[52] U.S. Cl. ..... 84/453; 84/281; 84/465

[58] Field of Search ..... 84/274, 278, 279, 281, 84/453, 465

[56] References Cited

U.S. PATENT DOCUMENTS 1,271,460 7/1918 Handel ..... 84/281

1,841,398 1/1932 Bergh ..... 84/465 X

*Primary Examiner*—Lawrence R. Franklin

*Attorney, Agent, or Firm*—Lilling & Greenspan

[57] ABSTRACT

The device consists of a chin rest which simulates the chin rest portion of a violin and rests on the shoulder of the violin player and underneath the chin. The hollow tube with markings extends from the chin rest portion of the device. A second tube telescopes into and out of the first tube and includes a marker that slides along a groove that is in juxtaposition to the markings on the first or hollow tube.

4 Claims, 4 Drawing Figures

VIOLIN STUDENT SIZING DEVICE

This invention corresponds to the disclosure document No. 152588, filed July 2, 1986, in the U.S. Patent and Trademark Office, and the complete disclosure of that disclosure document is hereby incorporated herein by reference.

BACKGROUND OF THE INVENTION

There is a need in the musical instruction industry for a method of determining the correct size violin for a student to use. Unlike most musical instruments, violins come in different sizes. The current method of determining the correct size of a violin is the so-called "trial and error" method. The music teacher would take violins of different sizes and try them on the student until he finds a violin of the correct size. This is clearly an inefficient procedure and requires the music teacher to keep an inventory of violins of different sizes. As a result, it frequently requires the music teacher to send the student to a music instrument supply store in order to obtain a violin of appropriate size.

In order to alleviate this problem, some persons have used conventional yardsticks and have made appropriate markings for the different size violins. The problem with this procedure is that it is difficult to hold the yardstick in position and to accurately position one end of the yardstick under the chin and the other end in the middle of the palm of the outstretched arm.

The problem is overcome with the device of this invention because it provides a simple and efficient means of precisely determining the size violin that a student needs. In a quick one-step procedure, the music teacher can determine the correct sized violin and the violin can then be purchased for the student without there being any need for worry that the incorrect size has been selected.

SUMMARY OF THE INVENTION

The invention consists of a device that has a chin rest area on one end which simulates the chin rest portion of the violin. Extending from the chin rest area is a hollow tube on which there are markings for the variously sized violins. A second tube telescopes into and out from the first tube and includes a marker that slides along the surface of the first tube. The music teacher would place the chin rest of the device of this invention underneath the chin of the student as the chin rest of a violin would be placed. The second tube is then extended until its end rests in the center of the palm of the student's outstretched arm. The teacher would then look at the marker and determine the correct size of the violin.

BRIEF DESCRIPTION OF THE DRAWINGS

FIG. 1 is a top plan view of the violin student sizing device with different positions of the device being shown in phantom.

FIG. 2 is a cross-sectional view of the violin student sizing device taken substantially along lines 2—2 of FIG. 1.

FIG. 3 is a bottom plan view of the violin student sizing device.

DETAILED DESCRIPTION OF THE INVENTION

Figure 1:
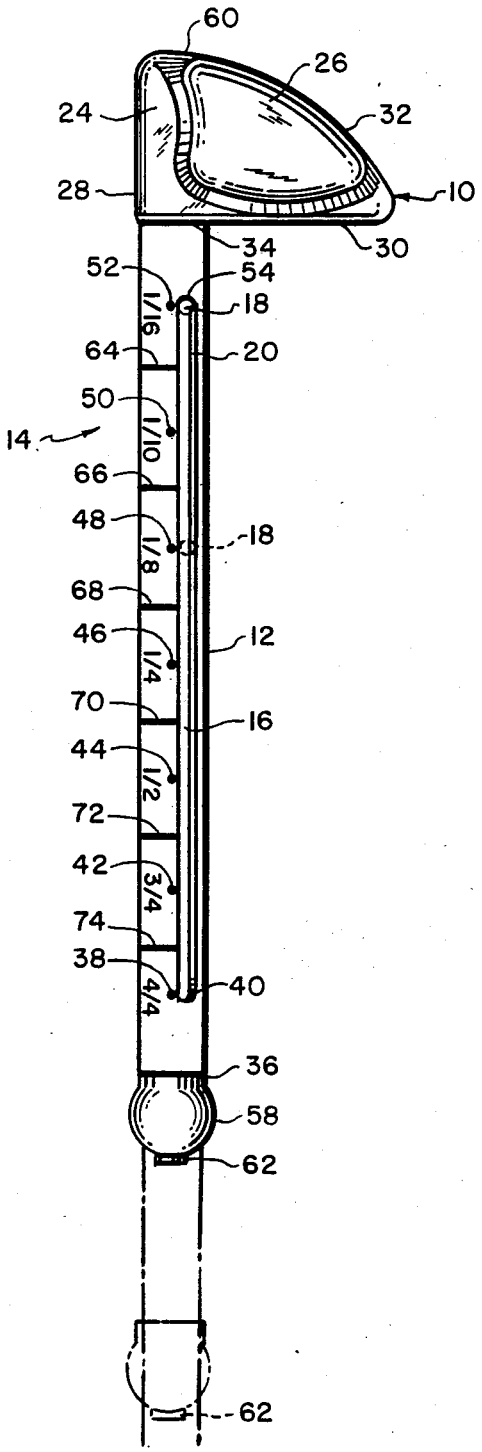
FIGS. 1, 2 and 3 of this application are drawn to scale and the scale is $\frac{1}{2}''=1''$.

The violin student sizing device is used to determine the correct size of violin for a violin student. The typical dimensions of a full-size or 4/4 size violin is 23.5". Because of the fact that not all people are the same size, over the years other sizes of violins have been made, and these sizes have become standardized. For example, a $\frac{3}{4}$ violin is 22", a $\frac{1}{2}$ size violin is 20.75", a $\frac{1}{4}$ size violin is 19", a $\frac{1}{8}$ size violin is 17.50", a 1/10 size violin is 16", and a 1/16 size violin is 14.5". It should be pointed out that the sizes, such as $\frac{1}{8}$, do not refer to the size of the violin with respect to a full-size violin. Thus, a $\frac{1}{2}$ size violin is not half the size of a full-sized violin, and a 1/10 size violin is not one-tenth the size of a conventional violin. These terms are terms of art which are used in the industry to identify the various violin sizes that are available.

According to conventional techniques, in order to determine the correct size of violin for a student, the teacher would place the violin in the student's hands in the playing position. That is, the chin rest on the bottom of the violin is placed underneath the chin of the student. The student would then extend his arm without bending his elbow. The correct sized violin would be one in which the scroll rests in the middle of the palm of the student's outstretched arm. The violin student sizing device also uses this principle.

The device of this invention includes a chin rest block 10, a hollow measuring rod 12 (first rod) with a measurement scale 14, and a length determining rod 16 (second rod) with a measuring dowel 18 that travels within a slot 20 on the surface of the first rod 12.

The invention may be made of any suitable material, but in the preferred embodiment it is made of polyvinyl chloride. Although the rods may be made of polyvinyl chloride, the chin rest 10 may be made of the same material or it could even be made of wood.

It is pointed out that the device shown in the drawings is for use by a right-handed player and the chin rest would be placed under the left side of the student's chin. In order to use the device for a left-handed violin student, the contour of the chin rest 10 would be reversed so that the device could fit under the right side of the chin of the student.

The chin rest 10 has a flat bottom 22 and the top surface 24 includes a depressed area 26 on which the chin of the student rests. The top surface 24 with the depression 26 should ideally conform in shape and configuration to the chin rest at the bottom end of a violin. The chin rest 10 is essentially triangular in shape with the edges 28 and 30 being essentially flat in shape and the end 32 being arcuate in shape. The chin rest 10 may be of any suitable thickness so that the bottom surface 22 rests on the shoulder of the student and the depression 26 rests underneath the chin and left cheek of the student. In the preferred embodiments, it has been determined that the chin rest 10 should be 1-5/16" thick.

The measuring rod (first rod) 12 should be preferably $11\frac{1}{8}''$ long and is made hollow. It preferably should be round, but the invention could conceivably work with rods of different shapes. On one of its surfaces the measuring rod 12 includes an elongated slot 20 which is 9 3/16" in length, and begins $1\frac{1}{8}''$ from the inner end 34 of the rod 12 and ends $\frac{7}{8}$ from the outer end 36 of the measuring rod 12. It is important that these dimensions be kept reasonably accurate or the device will not correctly indicate the size violin that the student requires.

Though it may be true that there are certain precise sizes of violins, this does not mean that each violin player is an exact size. Thus, most violin players require a violin size that does not conform to any size violin that is manufactured. For this reason, the violin student sizing device shows the range within which each size violin may be appropriate. In other words, the $\frac{3}{4}$ size violin may be 22", but a person whose optimum size is $21\frac{1}{2}$" may be able to use this size violin. Accordingly, a $\frac{3}{4}$ size violin may be used for persons whose size ranges from $21\frac{1}{4}$" to $22\frac{3}{4}$"; a $\frac{1}{2}$ violin may be used for persons whose size ranges from $19\frac{3}{4}$" to $21\frac{1}{4}$"; a $\frac{1}{4}$ size violin may be used for persons whose size ranges from $18\frac{1}{4}$" to $19\frac{3}{4}$"; a $\frac{1}{8}$ size violin may be used for persons whose size ranges from $16\frac{3}{4}$" to $18\frac{1}{4}$" and the 1/10 size violin may be used for persons whose size ranges from $15\frac{1}{4}$" to $16\frac{3}{4}$". The full size violin would be used for anyone requiring a size of $22\frac{3}{4}$" or greater, a 1/16 size would be used from $14\frac{1}{2}$" to $15\frac{1}{4}$", and a 1/32 size violin would be used for anyone requiring a size smaller than 14.5".

As shown in FIG. 1, the measuring rod 12 has a measuring scale 14 on which the sizes 1/16, 1/10, etc. are written. This scale can be imprinted directlly on the measuring rod or the scale can be printed on a self-adhering tape or decal which is affixed to the measuring rod.

The dot 38 indicating the median size of the 4/4, or full size, violin corresponds to the end 40 of the elongated slot 20. The dot 42 indicating the median size of the $\frac{3}{4}$ size violin is $1\frac{1}{2}$" further in, the dot 44 indicating the median size of the $\frac{1}{2}$ size violin if $1\frac{3}{8}$" further in, the dot 46 for the $\frac{1}{4}$ size violin is $1\frac{5}{8}$" further in, the dot for the medean size of the $\frac{1}{8}$ size violin is $1\frac{5}{8}$" further in, the dot 50 for the median size of the 1/10 size violin is $1\frac{3}{8}$" further in, and the dot 52 for the median size of the 1/16 size violin corresponds to the inner end 54 of the elongated slsot 20.

Figure 2:
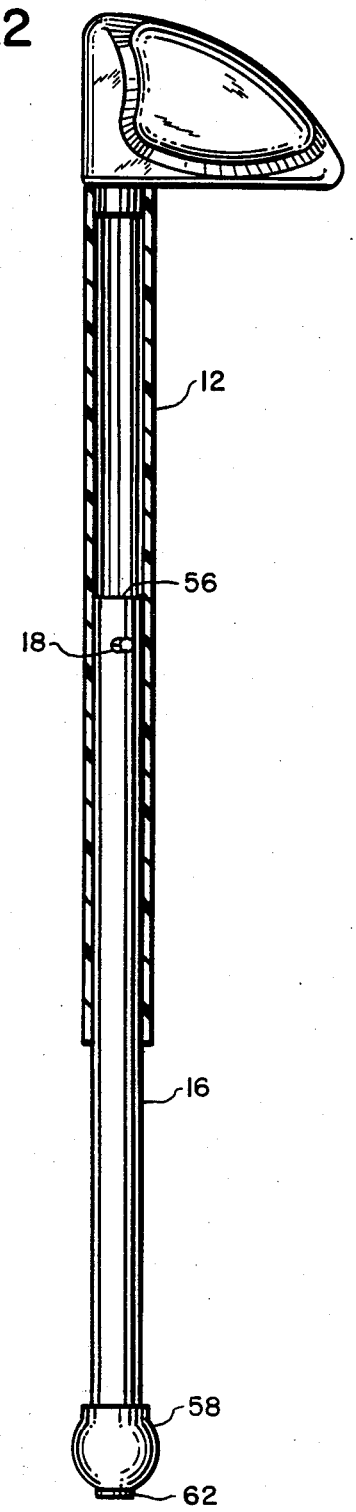
Figure 3:
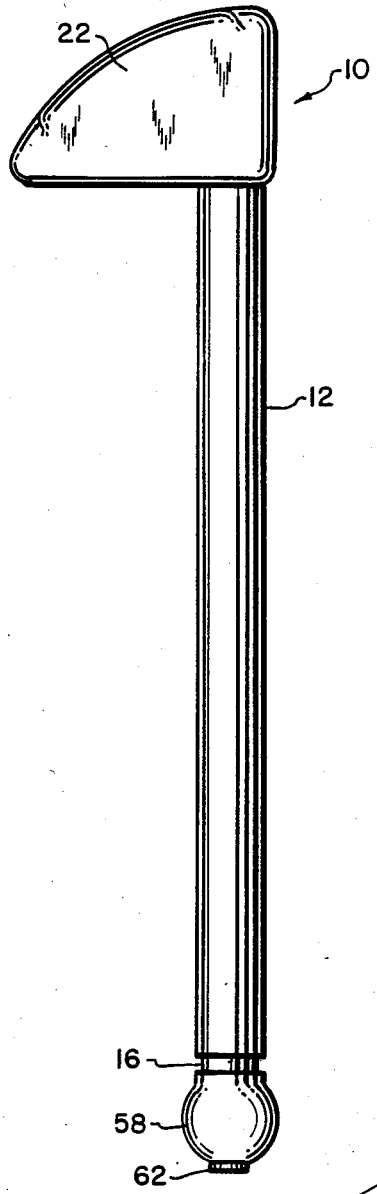

As shown in FIG. 2, the second rod 16 telescope within the hollow interior of the first rod 12. In the preferred embodiment, the first rod 12 has an outer diameter of 7/8" and an inner diameter of 11/16". The outer diameter of the second rod 16 is $\frac{5}{8}$".

The second rod 16 is designed to move smoothly within the hollow first rod 12 and the second rod 16 includes on its surface a measuring peg 18 or dowel that travels within the elongated slot 20 of the first rod 12. In the preferred embodiment the second rod 16 is $11\frac{3}{4}$" in length. The measuring peg 18 is positioned on a surface of the second rod 16 about 178 " in from the inner end 56 of the rod. A bulbous end piece 58 fits on the other end of the rod, so that the rod portion itself is approximately $10\frac{1}{2}$" in length and the bulbous end piece is approximately $1\frac{1}{4}$" in length.

Figure 4:
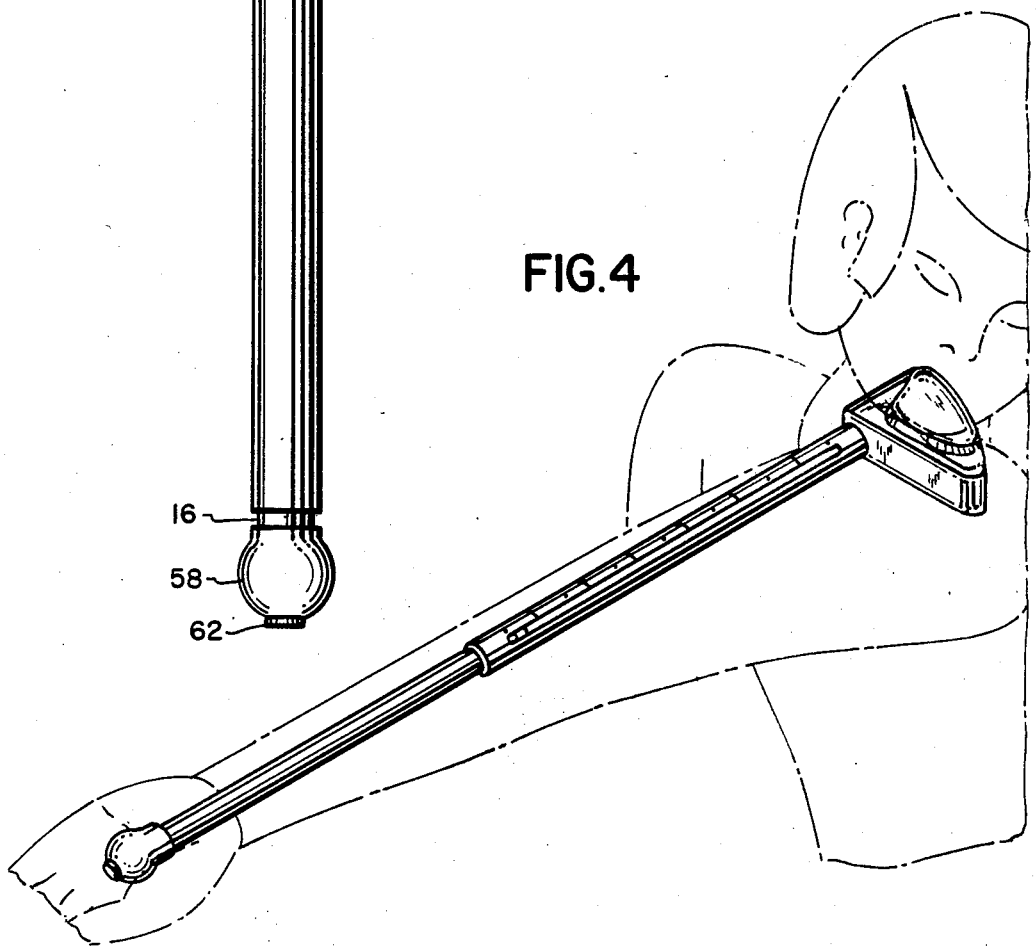
FIG. 4 is a perspective view showing the manner in which the violin student sizing device is used, and this drawing is not to scale.

FIG. 4 illustrates the manner in which the invention may be used. The bottom surface 22 of the chin rest 10 rests on the left shoulder of the student and the chin and a portion of the left cheek rests within the depressin 26 on the chin rest 10. The student then stretches out his arm, without bending the elbow, and the second rod 16 is moved outward from the first rod 12 until the bulbous end piece 58 fits in the middle of the palm of the left hand of the student. The teacher or student would then look at the measuring peg 18 and the measuring scale 14 to see which size of violin is the correct size for this particular student.

When the rod 16 is pushed all the way into the first rod 12, and only the bulbous end piece 58 is extending out of the first rod 12, the measuring peg 18 would be aligned with the marker 52 for the median size of the 1/16 size violin. This is the smallest size that can be measured with this device. If this size is still too big for the student, then the instructor would know that the correct size is the 1/32 size violin, which is the smallest that is currently available. In this closed position (position A FIG. 1), the entire length of the device from the inner end 60 of the chin rest 10 to the distal end 62 of the bulbous end piece is $14\frac{1}{2}$", which is the median size of the 1/16 size violin. At the opposite end of the spectrum, when the rod 16 is completely extended, the measuring peg 18 is in alignment with the marker 38 for the median size of the full or 4/4 , size violin. In this position, the distance from the top end 60 of the chin rest 10 to the distal end 62 of the bulbous end piece 58 is $23\frac{1}{2}$", which is the median size of the full-size, or 4/4 size, violin.

Thus, the device can be made to move to various sizes in order to simulate the various sizes of violins. As mentioned, the median size of the 1/16 size violin is $14\frac{1}{2}$" (as indicated by the marker 52). The line 64 indicates the maximum that could comfortably use a 1/16 size violin and the smallest that could comfortably use a 1/10 size violin, and, in this position, it would represent a $15\frac{1}{4}$" size violin. The marker line 66 would represent a $16\frac{3}{4}$" violin, the marker line 68 would represent a violin size of $18\frac{1}{4}$", the marker line 70 would represent a violin size of $19\frac{3}{4}$", the marker line 72 would represent a violin size of $21\frac{1}{4}$", and the marker line 74 would indicate a violin size of $22\frac{3}{4}$".

It is thus evident that this invention provides a simple and efficient method of determining the correct size of violin by a violin student.

I claim:

1. A violin student sizing device comprises: a chin rest having a flat bottom surface that rests on the shoulder of the student and a top surface with a depression that conforms in configuration to the chin rest of a violin and which the chin and cheek of the student rest; a first rod having an elongated slot and markings in juxtaposition to said slot and connected to said chin rest; and a second rod telescoping within said first rod and having a measuring dowel that slides within said elongated slot of said first rod; and wherein the length of said sizing device ranges from approximately $14\frac{1}{2}$" to $23\frac{1}{2}$".

2. A violin student sizing device according to claim 1, wherein said first rod is $11\frac{1}{4}$" in length and the elongated slot is $9\frac{1}{4}$" in length and begins 1" from the inner end of said first rod.

3. A violin student sizing device according to claim 2, wherein the markings on the scale for the 1/16 size violin corresponds with the inner end of the elongated slot, the marking on the scale for the 1/10 size violin is $1\frac{5}{8}$" from the marking for the 1/16 size violin, the marking for the $\frac{1}{8}$ size violin is $1\frac{3}{8}$" from the marking for the 1/10 violin, the marking for the $\frac{1}{4}$ size violin is $1\frac{5}{8}$" from the marking for the $\frac{1}{8}$ size violin, the marking for the $\frac{1}{2}$ size violin is $1\frac{5}{8}$" from the marking for the $\frac{1}{4}$ size violin, the marking for the $\frac{3}{4}$ size violin is $1\frac{3}{8}$" from the marking for the $\frac{1}{2}$ size violin, and the marking for the 4/4 size violin is at the outer end of the elongated slot and $1\frac{1}{2}$" from the marking for the median size $\frac{3}{4}$ size violin.

4. A violin student sizing device according to claim 3, wherein the length of the second rod is $11\frac{3}{4}$", the measuring dowel is positioned $\frac{1}{2}$" from the inner end of the second rod, and the approximate length form the measuring dowel to the end of the second rod is $11\frac{1}{4}$".

* * * * *